US006260957B1

(12) United States Patent
Corley, Jr. et al.

(10) Patent No.: US 6,260,957 B1
(45) Date of Patent: Jul. 17, 2001

(54) INK JET PRINTHEAD WITH HEATER CHIP INK FILTER

(75) Inventors: Richard Earl Corley, Jr., Lexington; Carl Edmond Sullivan, Versailles; Paul Timothy Spivey, Nicholasville, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/467,800

(22) Filed: Dec. 20, 1999

(51) Int. Cl.[7] ..... B41J 2/05; B41J 2/175
(52) U.S. Cl. ..... 347/63; 347/67; 347/93
(58) Field of Search ..... 347/63, 65, 93, 347/67; 29/890.1

(56) References Cited

U.S. PATENT DOCUMENTS

| | | | | |
|---|---|---|---|---|
| 4,639,748 | | 1/1987 | Drake et al. . | |
| 5,124,717 | | 6/1992 | Campanelli et al. . | |
| 5,141,596 | | 8/1992 | Hawkins et al. . | |
| 5,204,690 | | 4/1993 | Lorenze, Jr. et al. . | |
| 5,308,442 | | 5/1994 | Taub et al. . | |
| 5,387,314 | | 2/1995 | Baughman et al. . | |
| 5,537,136 | | 7/1996 | Brandon et al. . | |
| 5,585,011 | | 12/1996 | Saaski et al. . | |
| 5,610,645 | * | 3/1997 | Moore et al. | 347/93 |
| 5,658,471 | * | 8/1997 | Murthy et al. | 347/63 |
| 5,716,533 | | 2/1998 | O'Neill et al. . | |
| 5,742,314 | | 4/1998 | Hayes . | |
| 5,792,354 | | 8/1998 | Aksberg . | |

OTHER PUBLICATIONS

H.E. Burke, *Handbook of Magnetic Phenomena*, 1986; pp. 57–59.
G. Prinz, *Physics Today*, 1995; pp. 24–25.
L.H. Bennett, *Magnetic Multilayers*, 1994.
S.S.P. Parkin, *Physical Review Letters*, Dec. 16, 1991; pp. 3598–3601.
B. Heinrich, *Ultralthin Magnetic Structures II*, vol. II, 1994; 1 page.
P. Bruno, *Physical Review B*, vol. 52, No. 1, Jul. 1, 1995; pp. 411–439.
K.H. Gundlach, *Solid–State Electronics*, vol. 9, 1966; pp. 949–957.
K.H. Gundlach, *Thin Solid Films*, 4, 1969; pp. 61–79.
J.G. Simmons, *Journal of Applied Physics*, vol. 34, No. 6, Jun. 1963; pp. 1793–1803.
M. Di Ventra, *Computer in Physics*, vol. 12, No. 3, May/Jun. 1998; pp. 248–253.

* cited by examiner

*Primary Examiner*—John Barlow
*Assistant Examiner*—Juanita Stephens
(74) *Attorney, Agent, or Firm*—Taylor & Aust, P.C.

(57) ABSTRACT

A silicon ink filter for a heater chip of an ink jet printhead is formed by micromachining and laser drilling. The heater chip may contain a plurality of such filters for the plurality of nozzles of the printhead. The filter comprises a via constituting an ink entrance area formed by micromachining and a plurality of bores formed at the exit side of the via produced by laser drilling. Protective layers are preferably disposed over the heater chip substrate prior to micromachining and laser drilling.

24 Claims, 2 Drawing Sheets

INK JET PRINTHEAD WITH HEATER CHIP INK FILTER

BACKGROUND OF THE INVENTION

1. Field of the Invention

The present invention relates to printheads of ink cartridges for ink jet printing and, more particularly, to a filter for an ink jet cartridge printhead.

2. Description of the Related Art

There are several types of electronic printers currently in wide-spread use. One type is known as the laser printer while another type is known as the ink jet printer.

The laser printer utilizes toner from a toner cartridge deposited onto the print medium to produce printing. The ink jet printer utilizes ink from an ink cartridge assembly to deposit or jet ink onto a print medium such as paper in a predetermined pattern from a plurality of ink emitting orifices or nozzles.

Generally, ink jet printers are thermal, drop on demand systems that utilize thermal energy pulses to produce vapor bubbles in ink-filled channels, each channel in communication with an orifice or nozzle. The vapor bubbles produced in the ink-filled chambers which are connected to channels cause the ink to be expelled from the orifices. The channels are in communication with an ink reservoir. Thermal energy generators, usually resistors, are located in the chambers near the nozzle. The resistors are individually addressed with a current pulse to momentarily vaporize the ink and form a bubble that expels an ink droplet toward the print medium. The printhead includes the plurality of nozzles in a predetermined pattern.

The printhead includes a heater chip and nozzle plate. The heater chip is conventionally formed with active semiconductor devices in silicon. The heater chip includes arrays of resistive and active elements oriented both horizontally and vertically which when mated with a nozzle plate forms a path for thermal ejection of ink drops. Depending upon the physical orientation of the nozzle plate relative to the print receiving medium, the diameter of the nozzles and the spacing between nozzles determines the vertical size of the print swath, and the horizontal width and spacing determine the packing density and firing rate of the printhead. As printing speeds and resolution density increase, larger and larger arrays of smaller elements and smaller diameter nozzles are utilized.

Ink jet printers currently on the market generally have a resolution of 300 to 360 dpi (dots per inch). Ink jet printers with higher resolutions currently may reach 720 dpi or higher. As can be appreciated, printing at 720 dpi has approximately four times the resolution as 360 dpi. In other words, at 720 dpi a one inch square printing area contains 720×720 or 518,400 dots. A resolution of 360 dpi, on the other hand, has a 360×360 or 129,600 dots per one inch square printing area. The resolution depends at least in part on the configuration of the printhead. Because the number of nozzles must increase for higher dpi printing resolutions, the size or diameter of each nozzle must necessarily decrease in order to maintain the same size printhead.

Since the nozzle diameters are relatively small, mechanical filters are used to remove particles from the ink in ink jet print cartridges that if not filtered would tend to cause clogs in the nozzles. These mechanical filters are generally screen mesh filters disposed over what is known as a standpipe. The standpipe provides fluid communication between the ink supply and the printhead.

It is now conceivable for ink jet printers to have resolutions of 1200 dpi. Because of the small diameter nozzles necessary to achieve 1200 dpi, it will become essential to filter smaller particles from the ink with a smaller pressure drop. If filtration is inadequate, the resulting clogged nozzles will eventually lead to a failed printhead. Also, inadequate filtration leads to bad or unsightly printing.

What is thus needed is an ink filter for ink jet printers that will provide filtration of minute particles with a small pressure drop.

SUMMARY OF THE INVENTION

The present invention is directed to an ink filter for an inkjet printhead heater chip and method of manufacture.

The invention comprises, in one form thereof, an ink filter for a thermal inkjet printhead that is formed integral with the heater chip. The heater chip includes a substrate defining a first surface and a second surface, with the first and second surfaces being opposed, substantially parallel surfaces. A via in the substrate extends from the second surface a depth towards the first surface, the via formed by micromachining and defining a filter entrance. A plurality of holes are formed in the substrate by laser drilling, the plurality of holes extending from the first surface to the via and defining a filter exit. A heater element is disposed on the first surface adjacent the plurality of holes and is adapted to be electrically coupled to actuating circuitry.

The via may be rectangular with a first width at the second surface that is greater than a second width at the depth or at the point of intersection of the plurality of holes.

The invention comprises, in another form thereof, a method for forming a heater chip of an ink jet printhead with an ink filter. The heater chip is formed by providing a substrate having a first surface and a second surface, the first and second surfaces being substantially opposed, parallel surfaces. A first protective layer is formed on the first surface while a second protective layer is formed on the second surface. An ink filter via is micromachined in the substrate extending from the second protective layer towards the first surface a given depth while a plurality of holes are laser drilled through the first protective layer into the via. Thereafter, a heater element is provided on the first protective layer adjacent the plurality of holes.

Preferably, the step of micromachining includes patterning the second protective layer with an opening for the via by use of a photo sensitive material, transferring the pattern on the second protective layer into the substrate, and etching the pattern into the substrate.

The step of laser drilling a plurality of holes is preferably accomplished utilizing a YAG, excimer, carbon dioxide or diode pumped laser.

An advantage of the present invention is that an ink filter may be produced to trap minute particles in the ink with a small pressure drop in a heater chip for a thermal inkjet printhead.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates a preferred embodiment of the invention, in one form, and such exemplification is not to be construed as limiting the scope of the invention in any manner.

DETAILED DESCRIPTION OF THE INVENTION

Figure 1:
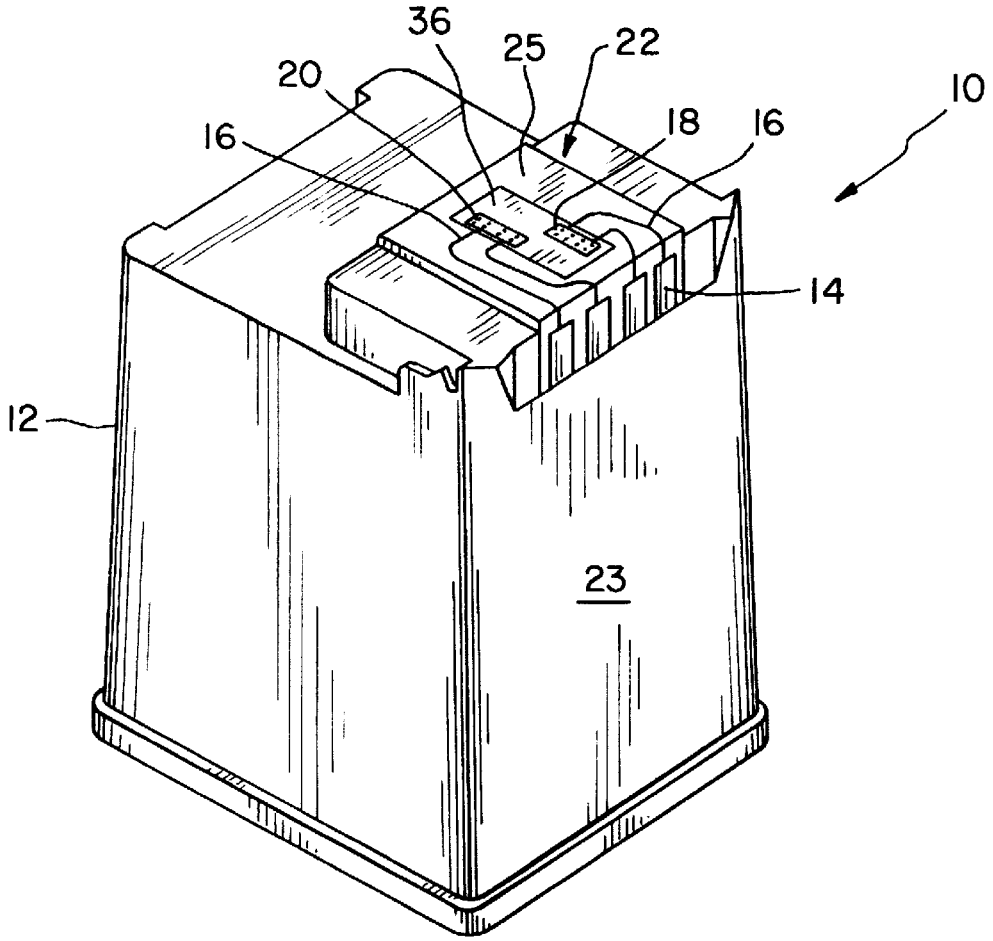
FIG. 1 is a perspective view of an ink jet print cartridge.

Referring now to the drawings and more particularly to FIG. 1, there is shown print cartridge 10 of the type utilized in an ink jet printer (not shown). Print cartridge 10 includes body 12 that houses an ink supply or reservoir (not shown) and tape automatic bonding (TAB) circuit 22, shown in simplified form in FIG. 1. TAB circuit 22 includes flexible tape 25, printhead area 36 having printheads 18 and 20, and contact pads 14 on side 23 in electrical communication with printheads 18 and 20 via electrical leads 16.

When installed in the ink jet printer (not shown), contact pads 14 accept electrical signals from the printer and supply them to the appropriate printheads 18 and/or 20 to selectively actuate the appropriate nozzles. Print cartridge 10 has one printhead area 36 that carries two printheads 18 and 20 each of which provides printing from a different ink retained with cartridge 10. The inks may be the same color but of different densities, or different colors. In general terms, the number of printheads signifies the number of different inks. Cartridge 10 may have one printhead or multiple printheads. Internally, print cartridge 10 contains conduits or standpipes (not shown) each with an associated mesh filter (not shown) that provide fluid communication between the ink supply and printheads 18 and 20.

Figure 2:
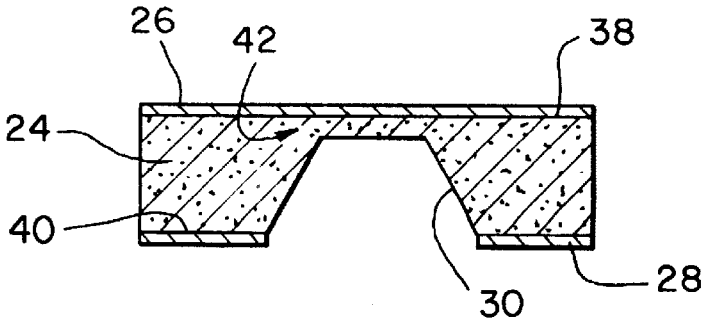
FIG. 2 is a side sectional view of a silicon wafer after formation of a via therein in accordance with an aspect of the present invention.

With reference now to FIG. 2 there is shown silicon wafer 24 which represents a portion of a larger silicon wafer that is formed into a heater chip forming a part of a printhead 18 and/or 20. Deposited onto surface 38 of silicon wafer 24 is protective or etch resistant layer 26, while deposited onto surface 40 is protective or etch resistant layer 28. The protective or etch resistant layers 26 and 28 may be any suitable material well known in the art.

Patterned by a photo-resistive etching process onto protective layer 28 is an opening that becomes via 30 or an entrance for the ink into the filter. The patterned opening may be square or rectangular with dimensions to optimize flow and space requirements. The material used for this patterning step could be photo resist or an equivalent photo sensitive material. After patterning, the pattern is transferred from the photo resist into the protective layer using reactive ion etching (RIE), or any other method known in the art. The pattern is then etched into silicon wafer 24 using potassium hydroxide (KOH), tetramethylammonium hydroxide (TMAH) or any other etchant known in the art to become via 30. The depth of via 30 etching is controlled or timed in order to leave an appropriate thickness 42 of silicon. While thickness 42 may theoretically be as thin as desired, practical considerations prevent thickness 42 from being too thin to handle without breaking.

Figure 3:
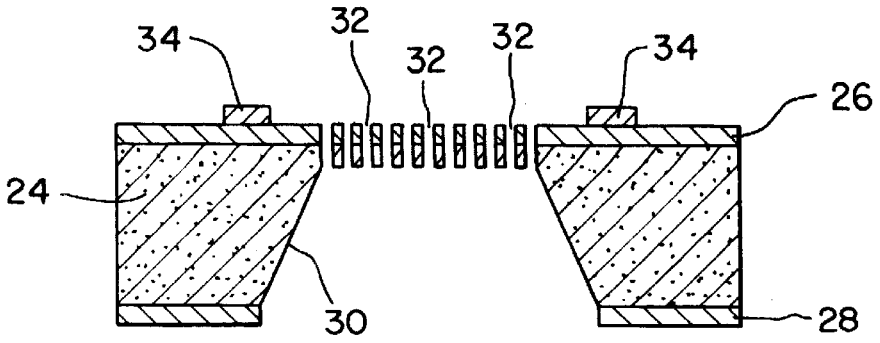
FIG. 3 is a side sectional view of the silicon wafer of FIG. 2 after formation of filter holes therein in accordance with an aspect of the present invention, and the addition of heater elements.
Figure 4:
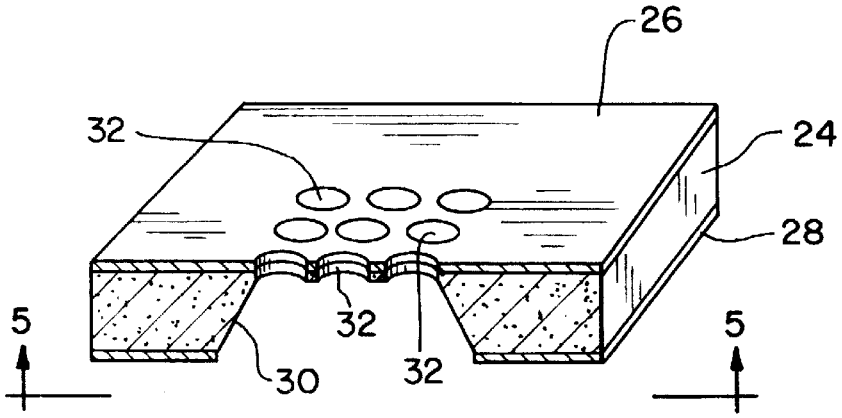
FIG. 4 is a perspective, sectional view of the silicon wafer of FIG. 3 with the heater elements removed.
Figure 5:
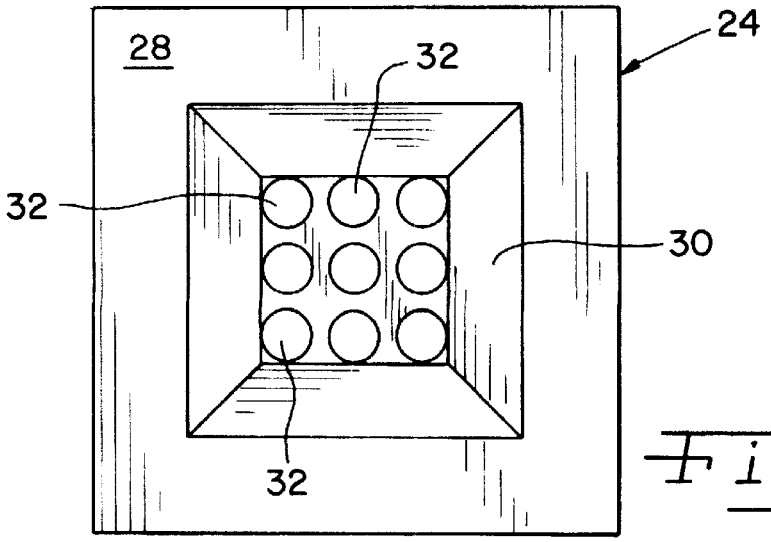
FIG. 5 is a bottom view of the silicon wafer of FIG. 4 taken along line 5—5 thereof.

With particular reference now to FIGS. 3, 4, and 5, after formation of via 30 it is necessary to provide a plurality of holes or bores 32 through thickness 42 to produce a filter area thereabove. The filter area receives filtered ink and is essentially disposed below the nozzles (not shown) of the nozzle plate (not shown) which is attached to silicon wafer 24. Holes 32 are formed by laser drilling utilizing an ultraviolet (UV) to infrared (IR) emission wavelength laser. Preferably, the laser is a Yttrium Aluminum Garnet (YAG) type laser (Q switched or pulsed), such as a neodymium (Nd:YAG) laser, erbium (Er:YAG) laser or holmium (Ho:YAG) laser, operating at a 1.063 $\mu$m wavelength. The aperture of the laser and the focal distance of the cutting beam determine the diameter of hole 32. The diameter of holes 32 determines the size of particles filtered by or prevented from flowing through the holes 32. The smaller the diameter of holes 32, the smaller the trapped particles. The pattern of holes 32 is essentially arbitrary.

As an example, it has been shown that an 11 $\mu$m diameter hole may be drilled using a power of 5K watts, a modulation frequency (Q rate) of 9 kHz, and a shutter speed of 1 $\mu$s. Currently, specification sheets for integrated YAG systems indicate hole sizes of 3 microns and drilling speeds of up to 50 holes per second achievable by pulsed YAG laser systems.

In FIG. 3 silicon wafer 24 includes the addition of heating elements 34 such as resistors that are electrically coupled to active circuits (not shown) which are in turn in electrical communication with contact pads 14 of TAB circuit 22. A nozzle plate (not shown) is then bonded over heating elements 34 thereby forming a printhead. The printhead is then bonded to TAB circuit 22 which is bonded to the print cartridge. Addition of heater elements 34 complete a heater chip from silicon wafer 24.

It should be understood that the filter shown in the Figures and described above is generally a single filter for an entire nozzle array for a printhead and thus forms an entrance to such nozzles. Alternatively, what is shown in the Figures may be only one filter that is associated with a smaller subset of the heating elements 34 within the heater chip. The heater chip for an ink jet cartridge printhead would include a plurality of such filters formed in the same manner as described above with generally one filter for one or more nozzles (shown but not numbered in FIG. 1) of the nozzle plate of printhead 18 or 20.

Additionally, in the embodiment of the present invention described above and shown in the attached drawings, the filter is formed from a single silicon wafer corresponding to a desired size of the filter. However, it is also possible to form a plurality of filters from a single silicon wafer blank having a size which is substantially larger than any single filter. The plurality of filters can be formed in the large blank in a manner as described above. Thereafter, the blank may be cut or diced into individual filters using a laser cutter or other suitable cutting device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heater chip for a thermal inkjet printhead comprising:

a substrate defining a first surface and a second surface, said first and second surfaces being opposed, substantially parallel surfaces, and at least one heater disposed on said first surface;

a via in said substrate extending from said second surface a depth towards said first surface, said via formed by micromachining and defining a filter entrance;

said substrate having a thickness between said depth of said via and said first surface; and a plurality of holes formed in said substrate by laser drilling, said plurality of holes extending through said thickness from said first surface to said via and defining a filter exit.

2. The heater chip of claim 1, further comprising a heater element disposed on said first surface adjacent said plurality of holes and adapted to be electrically coupled to actuating circuitry.

3. The heater chip of claim 1, wherein said via is rectangular.

4. The heater chip of claim 1, wherein said via has a first width at said second surface and a second width at said depth, and said first width is greater than said second width.

5. The heater chip of claim 1, wherein said plurality of holes are formed by laser drilling.

6. The heater chip of claim 5, wherein said laser comprises one of a Yttrium Aluminum Garnet laser, excimer laser, carbon dioxide laser and diode pumped laser.

7. A filter for use with a printhead cartridge in an ink jet printer, comprising:

a silicon wafer defining a first surface and a second surface, said first and second surfaces being opposed, substantially parallel surfaces, and at least one heater disposed on said first surface;

a first etch resistant layer disposed on said first surface;

a second etch resistant layer disposed on said second surface;

a via disposed in said silicon wafer and extending from said second etch resistant layer a depth toward said first surface, said via formed by micromachining and defining a filter entrance;

said silicon wafer having a thickness between said depth of said via and said first surface; and a plurality of bores extending through said thickness, from said first etch resistant layer to said via, said plurality of bores formed by laser drilling and defining a filter exit.

8. The filter of claim 7, further comprising a heater element disposed on said first etch resistant layer adjacent said plurality of bores and adapted to be electrically coupled to actuating circuitry.

9. The filter of claim 7, wherein said via is rectangular.

10. The filter of claim 7, wherein said via has a first width at said second etch resistant layer and a second width at said depth, and said first width is greater than said second width.

11. The filter of claim 7, wherein said plurality of bores are formed by laser drilling.

12. The filter of claim 11, wherein said laser comprises one of a Yttrium Aluminum Garnet laser, excimer laser, carbon dioxide laser and diode pumped laser.

13. In a heater chip for a thermal ink jet printhead, the heater chip defined by a silicon substrate having a first surface and a second surface generally opposite to and parallel with said first surface, and at least one heater element disposed on said first surface, an ink filter comprising:

a via formed in the silicon substrate by micromachining and extending from said second surface a depth toward said first surface, said via defining an ink filter entrance;

said silicon substrate having a thickness between said depth of said via and said first surface; and a plurality of holes extending through said thickness from said first surface adjacent the heater element to said via and formed by laser drilling, said plurality of holes defining an ink filter exit.

14. The ink filter of claim 13, further comprising:

a first etch resistant layer disposed on said first surface below the heater element; and a second etch resistant layer disposed on said second layer.

15. The ink filter of claim 13, wherein said via is rectangular.

16. The ink filter of claim 13, wherein said plurality of holes are formed by laser drilling.

17. The ink filter of claim 16, wherein said laser is a Yttrium Aluminum Garnet laser.

18. The ink filter of claim 13, wherein said via has a first width at said second surface and a second width at said depth, and said first width is greater than said second width.

19. A method of manufacturing a filter for a printhead cartridge used in an ink jet printer, the method comprising the steps of:

providing a substrate having a first surface and a second surface, the first and second surfaces being substantially opposed, parallel surfaces, and at least one heater disposed on said first surface;

forming a first protective layer on the first surface;

forming a second protective layer on the second surface;

micromachining an ink filter via in the substrate extending from the second protective layer towards the first surface a given depth, leaving a thickness of the substrate between the depth of the via and the first surface; and laser drilling a plurality of holes through the first protective layer into the via through the thickness of the substrate between the depth of the via and the first surface.

20. The method of claim 19, further comprising the step of providing a heater element on the first protective layer adjacent the plurality of holes.

21. The method of claim 19, wherein said plurality of holes each have a diameter of between 3 $\mu$m and 11 $\mu$m inclusive.

22. The method of claim 19, wherein the step of micromachining includes the steps of:

patterning the second protective layer with an opening for the via by use of a photo sensitive material;

transferring the pattern on the second protective layer into the substrate; and etching the pattern into the substrate.

23. The method of claim 19, wherein the step of laser drilling a plurality of holes is accomplished utilizing a laser.

24. The method of claim 23, wherein said laser comprises one of a Yttrium Aluminum Garnet laser, excimer laser, carbon dioxide laser and diode pumped laser.

* * * * *